US006354594B1

(12) United States Patent
Priester

(10) Patent No.: US 6,354,594 B1
(45) Date of Patent: Mar. 12, 2002

(54) FOLKSTYLE WRESTLING CARD GAME

(76) Inventor: Dayne T. Priester, 94 Liberty St., Jamestown, NY (US) 14701

( * ) Notice: Subject to any disclaimer, the term of this patent is extended or adjusted under 35 U.S.C. 154(b) by 0 days.

(21) Appl. No.: 09/545,278

(22) Filed: Apr. 7, 2000

(51) Int. Cl.[7] ..... A63F 1/00
(52) U.S. Cl. ..... 273/298
(58) Field of Search ..... 273/298, 244, 273/244.1, 244.2, 247, 259, 277

(56) References Cited

U.S. PATENT DOCUMENTS

| | | | | |
|---|---|---|---|---|
| 1,322,954 A | | 11/1919 | Rosenfeld | |
| 1,404,599 A | | 1/1922 | Glenny | |
| 1,640,261 A | | 8/1927 | Whaley et al. | |
| 3,310,308 A | | 3/1967 | Reagan | 273/134 |
| 4,793,617 A | | 12/1988 | Sanon | 273/298 |
| 4,861,031 A | | 8/1989 | Simms | 273/85 |
| 5,056,794 A | | 10/1991 | Simms | 273/298 |
| 5,071,136 A | * | 12/1991 | Lott | 273/259 |
| 5,163,688 A | | 11/1992 | Simms | 273/298 |
| 5,472,191 A | * | 12/1995 | Hendricks | 273/85 R |
| 6,022,023 A | * | 2/2000 | Ford, Jr. | 273/298 |

* cited by examiner

*Primary Examiner*—Raleigh W. Chiu
(74) *Attorney, Agent, or Firm*—Wayne L. Lovercheck

(57) ABSTRACT

A competitive card game which simulates the sport of wrestling according to the folkstyle rules. The game is comprised of a plurality of images with color codes; which illustrate the progression of moves, counter moves and scores where as allowed by the position of the wrestlers and the rules of the sport. Each player is dealt a hand of cards with two or more players competing to win. A win can be determined by a pin, highest score or getting rid of all cards in the players hand. The game can also be played by use of three-two minutes periods with the score of the players at the end of the third period or one minute overtime determining the highest score winner. Scores can also be kept individually by scholastic weight classes as in a dual, triangular or quadrangular match.

15 Claims, 5 Drawing Sheets

FROM BOTTOM POSITION

INSIDE SWITCH

REVERSAL R2

Fig-1A

FROM BOTTOM POSITION

OUTSIDE SWITCH

REVERSAL R2

Fig-1B

FROM BOTTOM POSITION

SIT OUT TRIPOD PETERSON

Figures 4G, 4H, 4I, 5A, 5B, 6:
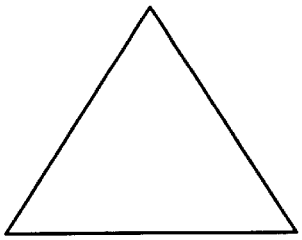

REVERSAL R2
NEAR FALL N3

Fig-1C

FROM BOTTOM POSITION

ELBOW ROLL CHEST TO CHEST PIN!

REVERSAL R2
NEAR FALL N3

Fig-1D

FROM BOTTOM POSITION

GRANBY ROLL

REVERSAL R2

Fig-1E

FROM BOTTOM POSITION

SIT OUT TRIPOD DUCKOUT

REVERSAL R2

Fig-1F

FROM BOTTOM POSITION

STAND UP

ESCAPE E1

Fig-1G

FROM BOTTOM POSITION

SIT OUT

OFFENSIVE OR DEFENSIVE POSITION

Fig-1H

FROM BOTTOM POSITION

TRIPOD

OFFENSIVE OR DEFENSIVE POSITION

Fig-1I

FROM NEUTRAL POSITION

HIP TOSS

TAKEDOWN T2
NEAR FALL N3

Fig-2A

FROM NEUTRAL POSITION

SINGLE LEG TAKEDOWN

TAKEDOWN T2

Fig-2B

FROM NEUTRAL POSITION

DOUBLE LEG TAKEDOWN

TAKEDOWN T2

Fig-2C

FROM NEUTRAL POSITION

ARM DRAG

TAKEDOWN T2

Fig-2D

FROM NEUTRAL POSITION

FIREMAN'S CARRY TO OPPONENT'S BACK

T2,N3

Fig-2E

FROM NEUTRAL POSITION

DUCK UNDER

TAKEDOWN T2

Fig-2F

FROM NEUTRAL POSITION

HEAD LOCK TO PIN!

T2,N3,6 TEAM Pts.

Fig-2G

FROM NEUTRAL POSITION

ANKLE PICK TO BACK

T2,N3

Fig-2H

BLOOD TIME

EMERGENCY

MEDICAL SERVICES

NEXT GRAPPLER

LOSE A TURN

Fig-3

FROM TOP POSITION

SPIRAL RIDE TO OPPONENT'S BACK

NEAR FALL N2

Fig-4A

FROM TOP POSITION

PUMPHANDLE TILT

NEAR FALL N2

Fig-4B

FROM TOP POSITION

INSIDE WRIST HALF TO PIN!

6 TEAM Pts.

Fig-4C

FROM TOP POSITION

FAR ARM CHOP

BREAKDOWN

Fig-4D

FROM TOP POSITION

DOUBLE KNEE BREAKDOWN

BREAKDOWN

Fig-4E

FROM TOP POSITION

TURK-CRADLE TO PIN!

6 TEAM Pts.

Fig-4F

FROM TOP POSITION

FAR SIDE CRADLE

NEAR FALL N2

FROM TOP POSITION

NEAR SIDE CRADLE

NEAR FALL N3

FROM TOP POSITION

3/4 NELSON TO HEAD

PIN!

COUNTER MOVE

WHIZZER

DEFENSIVE MOVE TO LEG ATTACK

COUNTER MOVE

SPRAWL

DEFENSIVE MOVE TO LEG ATTACK

BONUS CARD

CHOICE TOP BOTTOM OR NEUTRAL

FOLKSTYLE WRESTLING CARD GAME

CROSS REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

There have been numerous and varied games including card games devised which simulate real life sporting events as a form of entertainment. A few examples of these games include football, baseball and hockey.

Applicant is aware of the following U.S. Patents: U.S. Pat. No. 1,322,954 issued to Rosenfeld; U.S. Pat. No. 1,404,599 issued to Glenn; U.S. Pat. No. 1,640,261 issued to Whaley et al.; U.S. Pat. No. 3,310,308 issued to Reagan; U.S. Pat. No. 4,793,617 issued to Sanon; U.S. Pat. Nos. 4,861,031, 5,056,794 and, 5,163,688 all 3 of which were issued to Simms. Of these patents, only those issued to Simms relate to wrestling. However, there are improvements to the game of Simms that increase competition and entertainment to those interested in the sport. There is a need for a competitive card game that simulates the sport of wrestling with the finer points of the folkstyle rules.

BRIEF SUMMARY OF THE INVENTION

The present invention is directed to a card game that simulates the competition of a "Folkstyle rules" wrestling match.

It is an object of the present invention to provide a card game that simulates the action of a folkstyle wrestling match that is simple in construction, economical to manufacture and simple and efficient to use.

It is another object to provide a card game that; through the use of images and colors will illustrate the progression of moves, counter moves and scores where as allowed by the position of the wrestlers and the rules of the sport.

Two players can compete by playing against each other with the winner being determined by: pinning your opponent; getting rid of all cards in your hand; or by scoring more points than your opponent.

Three or more players can compete by playing as teams thereby winning by: pinning your opponent; getting rid of all cards in your hand; or by keeping score individually by a weight class as in a dual, triangular or quadrangular match. The match ends when all cards are used or no more cards can be played. Optionally the game can be played using three-two minute periods. The score at the end of the third period or a one-minute overtime determines the winner of that weight class.

Additionally the game can be played with players going through all of the interscholastic weight classes from one hundred to three pounds, through two hundred fifteen pounds to determine an over all winner in extended play.

The cards are color coded and marked with images of the position in order to speed the learning of the moves (or cards to be played) that can be made depending on the players current position and according to the rules of folkstyle wrestling. A brief description of the cards is:

Top cards are used when going for a pin.

Bottom cards are used for reversals or escapes.

Neutral cards are used for takedowns or pins.

Blood time cards are used for a time out.

Bonus cards are used anytime, free choice for top, bottom, or neutral.

The game is played by shuffling the deck and distributing five cards to each player with the remainder of the cards being excess. The game starts with both wrestlers in the neutral position.

To begin the game, the first player must play a neutral (black) card which is a takedown card. Player 2 (opponent) must play either a counter (orange) which keeps both players in the neutral position, or a green card (bottom) because they have been taken down to the mat and are in the bottom position. Counter (orange) cards can only be played after a neutral (black) card has been played.

Once on the bottom, you can only play another bottom (green) or bonus/choice (purple) card or a blood time (red) card. Bonus (purple) and blood time (red) cards can be played any time except the start of the game when a Neutral position card must be played. If the bottom card says reversal, another bottom (green), bonus (purple) or blood time (red) card must be played by the next player. If the bottom card (green) says offensive or defensive position, the next player must play a top (blue), bonus (purple) or blood time (red) card, because there is no change of position. When in the bottom (green) position and you play another bottom (green) card that says escape, the next player must play a neutral (black) card.

When you are on the top position, you can only play another top (blue), or a bonus (purple) or blood time (red) card.

If a player does not have the correct position or color card to play, they must draw a card from the top of the deck and must forfeit that turn. The next player must play an appropriate card for the position he is in, top, bottom, or neutral. A bonus or blood time card may also be played, because they can be played at any time. If a player plays a blood time (red) card, his opponent loses a turn and the player who played the blood time card (red) must play again. If a player plays a bonus/choice card (purple) he can choose top, bottom, or neutral position.

There are six pin cards: One from the neutral position, one from the bottom position, and four from the top position.

The player that places the pin card is automatically the winner.

There are four ways to win the game:

1. Be the first player to play all the cards in your hand.
2. Play a "pin" card.
3. Keep score as in an individual match by weight class. The match ends when all the cards in the draw pile are used or no more cards can be played. You can also play a suggested time limit. Applicant suggests a maximum time limit of five minutes.
4. Score all individual matches as in #3 above, and go through all interscholastic weight classes from 103 pounds through 215 pounds to determine a winner.

All scoring for cards that require scoring are printed on them.

To continue play; the winning player and all other players will draw enough cards to make five cards in their hands. The person to the left of the winner (if more than two playing the game) begins the next game. If you play by weight classes, after each weight class all players should begin by having five cards in their hand.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE SEVERAL VIEWS OF THE DRAWING(S)

FIGS. 1*a–i* illustrate the various Bottom Position cards each bearing indicia indicating from bottom position, a folkstyle wresting move from the bottom position, and a score or result.

FIGS. 2*a–h* illustrate the various Neutral Position cards each bearing indicia indicting from neutral position, a folkstyle wrestling move from the neutral position, and a score or result.

FIG. 3 illustrates a Blood Time card, each Blood Time card bearing indicia indicting a Blood Time card, next grapple and a result, lose a turn.

FIGS. 4*a–i* illustrate the various Top Position cards each bearing indicia indicting from top position, a folkstyle wrestling move from the top position, and a score or result.

FIGS. 5*a–b* illustrate the various Counter Move cards each bearing indicia indicting counter move, a folkstyle wrestling counter move, and a result.

FIG. 6 illustrates a Bonus Card each bearing the indicia indicating Bonus Card, a choice of result and the choice of top, bottom or neutral position.

DETAILED DESCRIPTION OF THE INVENTION

Now with more particular reference to the drawings, as shown in the FIGS. 1*a–i*, 2*a–h*, 3, 4*a–i*, 5*a–b*, and 6, the folkstyle wrestling card game is made up of a plurality of cards with indicia indicating position of wrestler (top, neutral, or bottom) wrestling move and score or result all as dictated by the folkstyle wrestling rules as commonly used in high school and college wrestling competitions.

The object: The object of the game is to beat your opponent by: pinning, scoring more points than your opponent, or by using all of the cards in your hand.

Number of players: Two to four is best.

Ways to win: You can win by pinning your opponent; getting rid of all of the cards in your hand; or keep score individually by weight class as in a dual, triangular or quadrangular match.

How to play: Shuffle the deck and distribute five cards to each player. Set the left over cards face down to be used to draw from when you cannot play a card in your hand. The game starts with both wrestlers in the neutral position. Determining who begins can be done by any method the players chose. After determining who begins, that player plays a card marked "neutral". If that player does not have a "neutral" card that player draws one from the excess cards and loses that turn. (They cannot play the drawn card). The next player than begins the game or draws a card until one of them plays a neutral position card. When the first "neutral" card is played, it is placed next to the excess pile.

Just like a real wrestling match, after being taken down, the "bottom" wrestler needs an appropriate move card to escape or reverse his opponent. Depending on what card is thrown will determine what type of move is needed. The next player must than throw a "top", "bottom" or "neutral" card.

Cards marked "counter" can be played to defend a "takedown". Play would continue in the neutral position until a takedown is completed. A "bonus" card can be played anytime and the appropriate "top", "bottom" or "neutral" position can be selected.

When there is a pin: After a card has been played marked "pin", the player that places that card is automatically the winner. The winning player than draws the number of cards to equal five and all other players draw enough to make five in their hands. If a player has more than five cards left in his hand, the winner of the game selects which card the opponent must place on the bottom of the deck from which you draw. When all players have five cards in their hand, the person to the left of the winner (if more than two playing the game) begins the next game. If you play by weight classes, after each weight class all players should begin by having five cards in their hand. (An option here is to play using three-two minute periods). The score at the end of the third period or a one-minute overtime determines the winner of that weight class.

The cards are color coded in the following manner: Top is blue, Bottom is green, Neutral is black, Counter is orange, and Bonus is purple. This will help you learn which move can be made from what position, (i.e., a takedown is neutral, so you cannot throw a neutral card from a top or bottom position). Make sure you keep track of what position you are because you cannot play a card that is impossible or illegal to use in folkstyle wrestling.

Top cards are used when going for a pin.

Bottom cards are used for reversals or escapes.

Neutral cards are used for takedowns or pins.

Bonus cards are used anytime, free choice for top, bottom, or neutral.

Use basic folkstyle wrestling rules and principals. Play is made more realistic by providing different numbers of particular cards based on the frequency of occurrence of each move in typical folkstyle wrestling. From the "neutral" position there may be provided three Double Takedown cards, three Single Takedown cards and one each of all other neutral position cards. From the "top" position there may be provided two Inside Wrist, Half to Pin cards and one each of all other top position cards. From the "bottom" position there may be provided two Inside Switch cards, four Stand Up cards and one each of all other bottom position cards. As to the "counter" cards, there may be provided two Whizzer cards and two Sprawl cards. As to the Blood Time cards, two cards may be provided and as to the Bonus cards five cards may be provided.

To begin the game, the first player must play a neutral (black) card which is a takedown card. Player 2 (opponent) must play either a counter (orange) which keeps both players in the neutral position, or a green card (bottom) because they have been taken down to the mat and are in the bottom position. Counter (orange) cards can only be played after a neutral (black) card has been played.

Once on the bottom, you can only play another bottom (green) or bonus/choice (purple) card or a blood time (red) card. Bonus (purple) and blood time (red) cards can be played any time except the start of the game when a Neutral position card must be played. If the bottom card says reversal, another bottom (green), bonus (purple) or blood time (red) card must be played by the next player. If the bottom card (green) says offensive or defensive position, the next player must play a top (blue), bonus (purple) or blood time (red) card, because there is no change of position. When in the bottom (green) position and you play another bottom (green) card that says escape, the next player must play a neutral (black) card.

When you are on the top position, you can only play another top (blue), or a bonus (purple) or blood time (red) card.

If a player does not have the correct position or color card to play, they must draw a card from the top of the deck and must forfeit that turn. The next player must play an appropriate card for the position he is in, top, bottom, or neutral. A bonus or blood time card may also be played, because they can be played at any time. If a player plays a blood time (red) card, his opponent loses a turn and the player who played the blood time card (red) must play again. If a player plays a bonus/choice card (purple) he can choose top, bottom, or neutral position.

There are six pin cards: One from the neutral position, one from the bottom position, and four from the top position.

There are four ways to win the game:

1. Be the first player to play all the cards in your hand.
2. Play a "pin" card.
3. Keep score as in an individual match by weight class. The match ends when all the Cards in the draw pile are used or no more cards can be played. You can also play a suggested time limit. Applicant suggests a maximum time limit of five minutes.
4. Score all individual matches as in #3 above, and go through all interscholastic weight classes from 103 pounds through 215 pounds to determine a winner.

All scoring for cards that require scoring are printed.

The following explains what cards can be played on each card by color:

BOTTOM CARDS

A player gets put in the bottom position if he is (A) taken down from the neutral position, (B) reversed by the wrestler currently on the bottom by using another bottom card, or (C) a player chooses the bottom position with the bonus/choice card. If a player playing the bonus/choice card chooses top, then his opponent is on the bottom. The player playing the bonus/choice card may choose to put himself on the bottom, also.

When the FIG. 1*a* INSIDE SWITCH (green) card is played, the following GREEN cards must be played on this card. Outside Switch, Inside Switch, Sitout, Granby Roll, Sitout Tripod Peterson, Tripod, Stand Up, Sitout Tripod Duckout, Elbow Roll Chest to Chest, PIN! Also, the Blood Time (red) and Bonus or Choice (purple) cards may be played.

When the FIG. 1*b* OUTSIDE SWITCH (green) card is played, the following GREEN cards must be played on this card. Sitout, Granby Roll, Sitout Tripod Peterson, Inside Switch, Tripod, Stand Up, Sitout Tripod Duckout, Elbow Roll Chest To Chest, PIN! Also, the Blood Time (red) and Bonus or Choice (purple) cards may be played.

When the FIG. 1*c* SITOUT TRIPOD PETERSON (green) card is played, the following GREEN cards must be played on this card. Inside Switch, Sitout, Granby Roll, Tripod, Stand Up, and, Elbow Roll Chest To Chest PIN! Outside Switch, and Sitout Tripod Duckout. Also, the Blood Time (red) and Bonus or Choice (purple) cards may be played.

When the FIG. 1*d* ELBOW ROLL CHEST TO CHEST PIN! (green) card is played, no card can be played on this card. A PIN ends the Game. The player who throws the Pin Card wins. A new game must begin.

When the FIG. 1*e* GRANBY ROLL (green) card is played, the following GREEN cards must be played on this card. Inside Switch, Sitout Tripod Peterson, Tripod, Sitout, Stand Up, Elbow Roll Chest To Chest, PIN! and, Sitout Tripod Duckout. Also, the Blood Time (red) and the Bonus or Choice cards can be played.

When the FIG. 1*f* SITOUT TRIPOD DUCKOUT (green) card is played, the following GREEN cards must be played on this card. Granby Roll, Inside Switch, Sitout Tripod Peterson, Tripod, Sitout, Stand Up, and, Elbow Roll Chest to Chest, PIN! Also, the Blood Time (red) and, the Bonus or Choice (purple) cards can be played.

When the FIG. 1*g* STAND UP (green) card is played, all Black/Takedown cards may be played on this card. They are Hip Toss, Arm Drag, Ankle Pick To Back, Fireman's Carry To Back, Duck Under, Double Leg Takedown, Single Leg Takedown, and Head Lock to PIN! Also, the Blood Time (red) and Bonus or Choice (purple) cards can be played.

When the FIG. 1*h* SITOUT (green) card is played, all Blue/Top cards may be played on this card. They are Nearside Cradle, Far Side Cradle, Double Knee Breakdown, Pumphandle Tilt, Far Arm Chop, Spiral Ride To Opponent's Back, Inside Wrist Half To PIN, Turk To Cradle To PIN, ¾ Nelson To Head, and PIN. Also, the Blood Time (red) and Bonus or Choice Cards (purple) cards can be played.

When the FIG. 1*i* TRIPOD (green) card is played, all Blue/Top cards may be played on this card. They are Near Side Cradle, Far Side Cradle, Double Knee Breakdown, Pumphandle Tilt, Far Arm Chop, Spiral Ride To Opponent's Back, Inside Wrist Half To PIN, Turk To Cradle To PIN, ¾ Nelson To Head, PIN. Also, the Blood Time (red) and Bonus or Choice cards (purple) cards can be played.

TAKEDOWNS FROM THE NEUTRAL POSITION

Only a neutral card can begin the game, not a bonus/choice card. There are only two times a player can play a neutral (takedown) card. First is when the preceding player plays a bottom card that is an escape, which puts the wrestlers in a neutral position standing like the beginning of a match. The other time is if a player plays a bonus/choice card and chooses the neutral position.

When the FIG. 2*a* HIP TOSS (black) card is played, the following cards can be played in response: Sprawl (orange); Whizzer (orange); Granby Roll (green); Stand Up (green); Sitout, Tripod, Peterson (green); Tripod (green); Sitout (green); Elbow Roll, Chest To Chest, PIN (green); Inside Switch (green); Outside Switch (green); Sitout, Tripod, Duckout (green); Blood Time (red); and, Bonus or Choice (purple).

When the FIG. 2*b* SINGLE LEG TAKEDOWN (black) card is played, the following cards can be played in response: Sprawl (orange); Whizzer (orange); Granby Roll (green); Stand up (green); Sitout, Tripod, Peterson (green); Tripod (green); Sitout (green); Elbow Roll Chest to Chest, PIN (green); Inside Switch (green); Outside Switch (green); Sitout, Tripod, Duckout (green); Blood Time (red); and, Bonus or Choice (purple).

When the FIG. 2*c* DOUBLE LEG TAKEDOWN (black) card is played, the following cards can be played in response: Sprawl (orange); Whizzer (orange); Granby Roll (green); Stand up (green); Sitout, Tripod, Peterson (green); Tripod (green); Sitout (green); Elbow Roll Chest to Chest, PIN (green); Inside Switch (green); Outside Switch (green); Sitout, Tripod, Duckout (green); Blood Time (red); and, Bonus or Choice (purple).

When the FIG. 2*d* ARM DRAG (black) card is played, the following cards can be played in response: Sprawl (orange);

Whizzer (orange); Granby Roll (green); Stand Up (green); Sitout, Tripod, Peterson (green); Tripod (green); Sitout (green); Elbow Roll, Chest to Chest, PIN (green); Inside Switch (green); Outside Switch (green); Sitout, Tripod, Duckout (green); Blood time (red); and, Bonus or Choice (purple).

When the FIG. 2*e* FIREMAN'S CARRY TO OPPONENT'S BACK (black) card is played, the following cards can be played in response: Sprawl (orange); Whizzer (orange); Granby Roll (green); Stand up (green); Sitout, Tripod, Peterson (green); Tripod (green); Sitout (green); Elbow roll Chest to Chest, PIN (green); Inside Switch (green); Outside Switch (green); Sitout, Tripod, Duckout (green); Blood Time (red); and, Bonus or Choice (purple).

When the FIG. 2*f* DUCK UNDER (black) card is played, the following cards can be played in response: Sprawl (orange); Whizzer (orange); Granby Roll (green); Stand up (green); Sitout, Tripod, Peterson (green); Tripod (green); Sitout (green); Elbow Roll, Chest to Chest, PIN (green); Inside Switch (green); Outside Switch (green); Sitout, Tripod, Duckout (green); Blood Time (red); and, Bonus or Choice (purple).

When the FIG. 2*g* HEAD LOCK TO PIN (black) No card can be played. A PIN card ends the game and the player who plays this card wins the game. A new game must begin.

When the FIG. 2*h* ANKLE PICK TO BACK (black) card is played, the following cards can be played in response: Sprawl (orange); Whizzer (orange); Granby Roll (green); Stand up (green); Sitout, Tripod, Peterson (green); Tripod (green); Sitout (green); Elbow Roll Chest to Chest,PIN (green), Inside Switch (green); Outside Switch (green); Sitout, Tripod, Duckout (green); Blood Time (red); and, Bonus or Choice (purple).

BLOOD TIME

The FIG. 3 BLOOD TIME (red) card can be played at any time. When a player plays a Blood Time (red) card, he/she must play the appropriate card depending on the card played immediately before the Blood Time card depending on what that card (position) is. If they are on the bottom, they play Green, on top, Blue, and Neutral, Black. If they can't play, they draw a card and if it's the Correct color card, they can play it. If not, they lose that turn and their opponent plays.

TOP POSITION

TOP CARDS are played when the player is in the top position. They gain this position after they put their opponent in the bottom position and the opponent has to draw a card and thereby lose a turn. They also may play the Bonus/Choice card and choose the top position, as long as their opponent does not reverse them, they will remain in the top position to play a top card.

When the FIG. 4*a* SPIRAL RIDE TO OPPONENTS BACK (blue) card is played, the following GREEN cards are to be played after this card is played. Inside Switch, Outside Switch, Sitout Tripod Peterson, Granby Roll, Sitout, Stand Up, Tripod, Sitout Tripod Duckout, Elbow Roll Chest To Chest, PIN! Also, the Blood Time (red) and Bonus/Choice cards may be played.

When the FIG. 4*b* PUMPHANDLE TILT (blue) card is played, the following GREEN cards are to be played after this card is played. Inside Switch, Outside Switch, Sitout Tripod Peterson, Granby Roll, Sitout, Stand Up, Sitout Tripod Duckout, Tripod, Elbow Roll Chest to Chest, PIN! Tripod. Also, the Blood Time (red) and Bonus/Choice (purple) cards may be used.

When the FIG. 4*c* INSIDE WRIST HALF TO PIN (blue) card is played, no card can be played on this card. A PIN ends the Game. The Player who throws the Pin card wins. Another game must begin.

When the FIG. 4*d* FAR ARM CHOP (blue) card is played, the following GREEN cards are to be played after this card is played. Inside Switch, Outside Switch, Sitout Tripod Peterson, Granby Roll, Stand Up, Sitout, Tripod, Sitout Tripod Duckout, Elbow Roll Chest To Chest, PIN! Also, the Blood time (red) and Bonus/Choice cards may be played.

When the FIG. 4*e* DOUBLE KNEE BREAKDOWN (blue) card is played, he following GREEN cards are to be played after this card is played. Inside Switch, Outside Switch, Sitout Tripod Peterson, Granby Roll, Sitout, Sitout Tripod Duckout, Stand Up, Tripod, Elbow Roll Chest To Chest, PIN! Also, the Blood time (red) and Bonus/Choice (purple) cards may be played.

When the FIG. 4*f* TURK CRADLE TO PIN (blue) card is played, no card can be played on this card. A PIN ends the Game. The player who throws the pin card wins. Another game must begin.

When the FIG. 4*g* FAR SIDE CRADLE (blue) card is played, the following GREEN cards are to be played after this card is played. Inside Switch, Outside Switch, Sitout Tripod Peterson, Granby Roll, Sitout Tripod Duckout, Stand Up, Elbow Roll Chest to Chest, PIN! Sitout, Tripod. Also, the Blood time (red) and the Bonus/Choice (purple) card may be played.

When the FIG. 4*h* NEAR SIDE CRADLE (blue) card is played, the following GREEN cards are to be played after this card is played. Inside Switch, Outside Switch, Sitout Tripod Peterson, Granby Roll, Sitout Tripod Duckout, Stand Up, Elbow Roll Chest To Chest, PIN! Sitout, and, Tripod. Also, the Blood Time (red) card and The Bonus/Choice cards may be played.

When the FIG. 4I ¾ NELSON TO HEAD, PIN (blue) card is played, no card can be played on this card. A PIN ends the game. The player who throws the PIN card wins. Another game must begin.

COUNTER MOVES

A player can only use a counter card (Whizzer or Sprawl) when his opponent plays a neutral card. Since the neutral cards take the opponent down to the mat, these counter cards stop this takedown and keep the wrestlers in the neutral position on their feet, which then requires the next player to (a) play a bonus/choice card, or (b) play a neutral card.

When the FIG. 5*a* WHIZZER (orange) card is played, the following cards can be played in response: All black Take Down Cards; Single Leg, Double Leg, Fireman's Carry, Ankle Pick To Back, Duck Under, Hip Toss, Arm Drag, Head Lock to PIN! Also Bonus or Choice (purple); and, Blood Time (red) cards can be played.

When the FIG. 5*b* SPRAWL (orange) card is played, the following cards can be played in response: All Black Take Down cards; Single Leg; Double Leg; Fireman's Carry; Ankle Pick To Back, Duck Under, Hip Toss, Arm Drag, Head Lock To PIN! Also Bonus or Choice (purple) and Blood time (red) cards can be played.

BONUS CARD

BONUS/CHOICE (purple)—This card may be played anytime except the very first card of the game which must be black. The player who plays this card must choose top, bottom or neutral. The next player must then play the appropriate top (blue); bottom (green); or neutral (black) card or draw from the deck. If you draw from the deck, you cannot play the card drawn, and must forfeit that turn.

When the FIG. 6 BONUS/CHOICE (purple) card is played, this card may be played anytime except as the very first card of the game which must be black. The player who plays this card must choose top, bottom or neutral. The next player must then play the appropriate top (blue); bottom (green); or, neutral (black) card or draw from the deck. If you draw from the deck, you cannot play the card drawn, and must forfeit that turn.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A deck of playing cards for playing a game simulating folkstyle wrestling comprising:

a first plurality of cards bearing indicia indicative of a wrestler in a bottom position;

each card of said first plurality of cards bearing indicia indicative of a wrestling move from said bottom position;

a second plurality of cards bearing indicia indicative of a wrestler in a neutral position;

each card of said second plurality of cards bearing indicia indicative of a wrestling move from said neutral position;

a third plurality of cards bearing indicia indicative of a wrestler in a top position; and, each card of said third plurality of cards bearing indicia indicative of a wrestling move from said top position;

a fourth plurality of cards bearing indicia indicative of a wrestler making a counter move; and, each card of said fourth plurality of cards bearing indicia indicative of a wrestling counter move;

each card of said first plurality of cards bears indicia indicative of a score or a result of said wrestling move from said bottom position;

each card of said second plurality of cards bears indicia indicative of a score or result of said wrestling move from said neutral position;

each card of said third plurality of cards bears indicia indicative of a score or result of said wrestling move from said top position; and, each card of said fourth plurality of cards bears indicia indicative of a score or a result of said wrestling counter move.

2. The deck of playing cards in claim 1 further comprising one or more Blood Time cards bearing indicia indicative of a time out.

3. The deck of playing cards in claim 1 wherein each said Blood Time card bears indicia indicative of loss of a turn.

4. The deck of playing cards in claim 1 further comprising one or more Bonus Cards bearing indicia indicative of a choice of wrestler position.

5. The deck of playing cards in claim 4 wherein each said Bonus Card bears indicia indicative of choice of Top, Bottom or Neutral wrestler positions.

6. A method of playing cards for playing a game simulating folkstyle wrestling for two or more competitors;

said game having a deck of cards;

a first plurality of the cards bearing indicia indicative of a wrestler in a bottom position;

each card of said first plurality bearing indicia indicative of a wrestling move from said bottom position;

a second plurality of the cards bearing indicia indicative of a wrestler in a neutral position;

each card of said second plurality of cards bearing indicia indicative of a wrestling move from said neutral position;

a third plurality of cards bearing indicia indicative of a wrestler in a top position;

each said card of said third plurality of cards bearing indicia indicative of a wrestling move from said top position;

the method comprising the steps of:

distributing a predetermined number of playing cards to each player;

initiating play by playing a neutral position card;

continuing play by playing appropriate move cards determined by the position the wrestler is moving from and what wrestling move cards from said position the player is holding;

ending play by predetermined means; and, determining winner.

7. A method of playing cards recited in claim 6 comprising the further step of playing a counter move card to maintain the neutral position of the wrestler.

8. A method of playing cards recited in claim 6 comprising the further step of playing cards permitting a choice of wrestler position.

9. A method of playing cards recited in claim 6 comprising the further step of scoring the game based on the card indicia indicating score or result.

10. A method of playing cards recited in claim 6 comprising the further step of ending the game based on a time limit.

11. A method of playing a card game for two or more players that simulates a folkstyle wrestling match;

said game having a deck of cards;

each said card having indicia indicating a position a wrestling move and a score or result;

the method comprising the steps of:

distributing a predetermined number of cards to each player;

creating a draw pile with the remaining cards;

initiating each game with both players in a neutral position;

selecting for each move a card for the most advantageous move from the then current position of the wrestler; and, alternating play until game is concluded in predetermined manner.

12. The method of playing a card game recited in claim 11 comprising the further step of playing a counter move card to maintain the neutral position of the wrestler.

13. The method of playing a card game recited in claim 11 comprising the further step of playing cards permitting a choice of wrestler position.

14. The method of playing a card game recited in claim 11 comprising the further step of scoring the game based on the card indicia indicating score or result.

15. The method of playing a card game recited in claim 11 comprising the further step of ending the game based on a time limit.

* * * * *